US007384170B2

(12) United States Patent
Skegin

(10) Patent No.: US 7,384,170 B2
(45) Date of Patent: Jun. 10, 2008

(54) COUNTER LIGHT FIXTURE

(75) Inventor: Maer Skegin, West Hollywood, CA (US)

(73) Assignee: Troy-CSL Lighting, Inc., City Of Industry, CA (US)

( * ) Notice: Subject to any disclaimer, the term of this patent is extended or adjusted under 35 U.S.C. 154(b) by 0 days.

(21) Appl. No.: 10/751,280

(22) Filed: Dec. 30, 2003

(65) Prior Publication Data

US 2005/0141219 A1 Jun. 30, 2005

(51) Int. Cl.
*F21V 1/00* (2006.01)

(52) U.S. Cl. ..... 362/240; 362/127; 362/147; 362/223; 362/247

(58) Field of Classification Search ..... 362/240, 362/127, 147, 223, 247, 296, 300, 311, 224, 362/367
See application file for complete search history.

(56) References Cited

U.S. PATENT DOCUMENTS 4,811,183 A * 3/1989 Guritz et al. ..... 362/377
5,568,965 A * 10/1996 Eagan ..... 362/135
5,707,144 A * 1/1998 Gampe et al. ..... 362/374
6,419,378 B1 * 7/2002 Wedell et al. ..... 362/431

* cited by examiner

*Primary Examiner*—Sandra O'Shea
*Assistant Examiner*—Mark Tsidulko

(57) ABSTRACT

A counter light fixture has a fixture housing with a downward facing reflector and lamp sockets under the reflector, and a window panel hinged to the housing for access to the lamp sockets. The fixture housing is formed as a continuous extrusion including a wiring compartment which extends the length of the housing. The extrusion has a downwardly facing concave top section joined to an upwardly facing concave rear section. The reflector is under the downwardly facing concave top section, one or more lamp sockets are mounted under the reflector, the window panel is supported between opposite end caps of the housing under the downwardly facing concave top section, and the electrical wiring is contained in the upwardly facing concave rear section. The window panel slides away from a closed condition and then swings down to an open condition.

61 Claims, 7 Drawing Sheets

COUNTER LIGHT FIXTURE

BACKGROUND OF THE INVENTION

1. Field of the Invention

This invention pertains to the field of interior lighting and in particular relates to light fixtures suitable for mounting under wall hung cabinets for illuminating an underlying counter surface.

2. State of the Prior Art

Counter light fixtures are available in various designs. Continued improvement remains desirable.

SUMMARY OF THE INVENTION

The counter light fixture according to this invention has a housing having a housing top, a front, a rear, a reflector supported under the top and facing an underside of the housing, one or more lamp sockets supported under the reflector, and a translucent window panel supported under the reflector and hinged to the housing for movement between a closed operating condition and an open condition permitting access to the lamp sockets.

The window panel preferably defines a horizontal plane under the reflector and the window panel is displaceable generally along the horizontal plane between a captive condition and a released condition. Preferably the window panel is spring loaded into the captive condition and the window panel is released from the captive condition by pressing the window panel against the spring loading, for example, upwardly against the housing.

The window panel is displaceable between the closed condition and a released condition, and is pivotable between the released condition and the open condition. For example, the window panel may have a rear edge and a front edge, the rear edge being hinged to the housing, and the front edge releasable towards the open condition.

A detent may be provided for detaining the window panel against slidable movement, and the window panel can be spring loaded into engagement with the detent in the closed condition. The window panel may be released from the detent by pressing the window panel against the spring loading, as by pressing the window panel towards the housing top, and sliding the window panel over the detent.

A spring arrangement may be provided for urging the window panel away from the housing top thereby to provide ventilation into the housing. Preferably the window panel is supported in spaced relationship to the housing in the closed condition thereby to define a front ventilation slot, a rear ventilation slot or both a front ventilation slot and a rear ventilation slot.

In one embodiment of the invention the window panel has two opposite sides between its front edge and its rear edge and a front pin and a rear pin on each of the sides, each of the pins being captive in a corresponding slot in the housing, the front pin being slidable in the corresponding slot for freeing the front pin through an open forward end thereof thereby to release the window panel for movement about the rear pin to the open condition. The front pin and the rear pin can be integral with a clip fitted on each side of the window panel, and finger ridges may be defined on each clip.

A detent may be provided in the corresponding slot for retaining the front pin against sliding movement towards the open forward end in the slot, the detent allowing the front pin to be lifted over the detent and towards the open forward end thereby to free the front pin from the slot. A spring arrangement may be included urging the front pin into engagement with the detent. The spring arrangement may also urge the window panel away from the housing top thereby to admit ventilation therebetween.

In a presently preferred embodiment the fixture housing has a housing top and a rear compartment of approximately equal length between opposite housing ends. A partition transverse to the housing top may define a switch compartment between the partition and one of the housing ends, and a removable bottom cover is provided for closing the switch compartment with an electrical switch, which may be mounted on the bottom cover. A power transformer in the switch compartment may be connected for converting a line voltage input to a low voltage supply for the lamp sockets.

Electrical wiring in the rear compartment is connected to the lamp socket or sockets through openings in the housing top and the reflector, and the electrical wiring is connected to an electrical power switch, for example, on a removable bottom panel of the housing. Knock out openings may be provided on a back wall of the rear compartment for passing electrical power wiring into the rear compartment. Electrical connectors of male and female gender on the opposite housing ends may be provided for connecting end-to-end one counter light fixture to another counter light fixture. A power cord mateable to one of the male and female electrical connectors can supply electrical power to the lamp sockets.

The counter light fixture may be configured in varying lengths with increasing numbers of lamp sockets. In alternate embodiments the fixture has two or more translucent window panels each supported to the housing under a corresponding reflector and each window panel is independently releasable for movement between a closed operating condition and an open condition permitting access to corresponding lamp sockets.

In a more general aspect of this invention, the light fixture features a housing having a downwardly facing concave top section and an upwardly facing concave rear section, a reflector and lamp sockets supported under the downwardly facing concave top section, electrical wiring in the upwardly facing concave rear section connected for powering lamp bulbs in the lamp sockets, a translucent window panel under the reflector, and a removable top cover for covering the upwardly facing concave rear section to provide a closed wiring compartment which may extend the length of the fixture between opposite ends. In one form of the invention the downwardly facing concave top section and the upwardly facing concave rear section are formed unitary with each other and may be formed as an extrusion which may be of continuous cross section. The extrusion may be of metal such as aluminum for good heat conductivity and dissipation.

These and other improvements and features will be better understood by reference to the following detailed description of the preferred embodiments and accompanying drawings.

DETAILED DESCRIPTION OF THE PREFERRED EMBODIMENT

Figure 1:
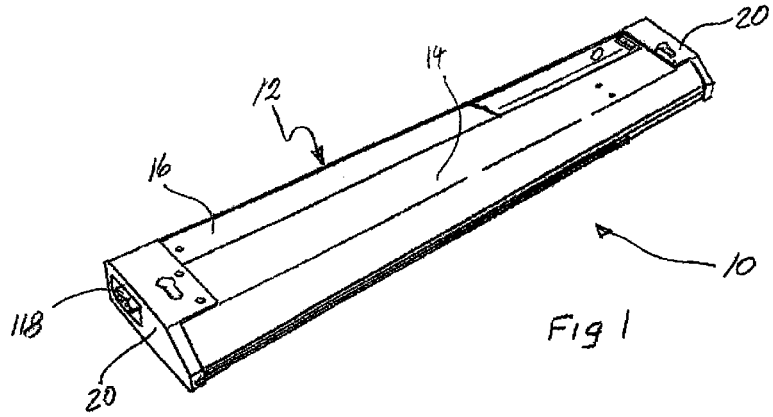
FIG. 1 is a top front perspective view of a counter light fixture according to this invention.
Figure 2:
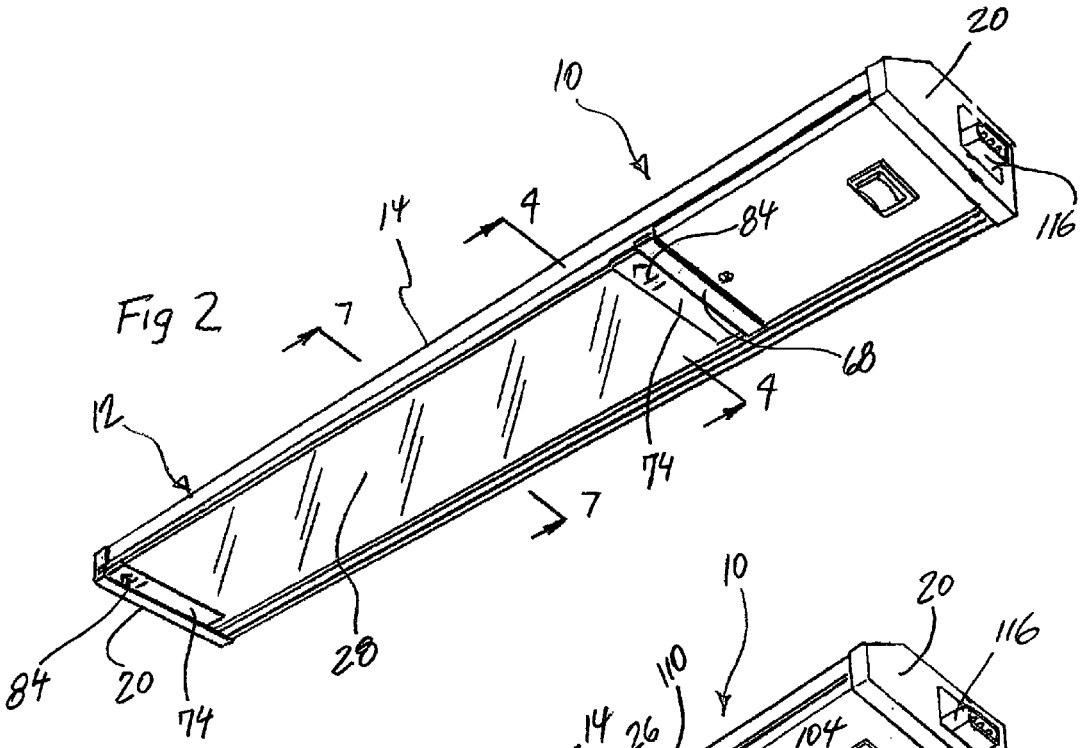
FIG. 2 is a front-bottom perspective view of the counter light fixture of FIG. 1.
Figure 3:
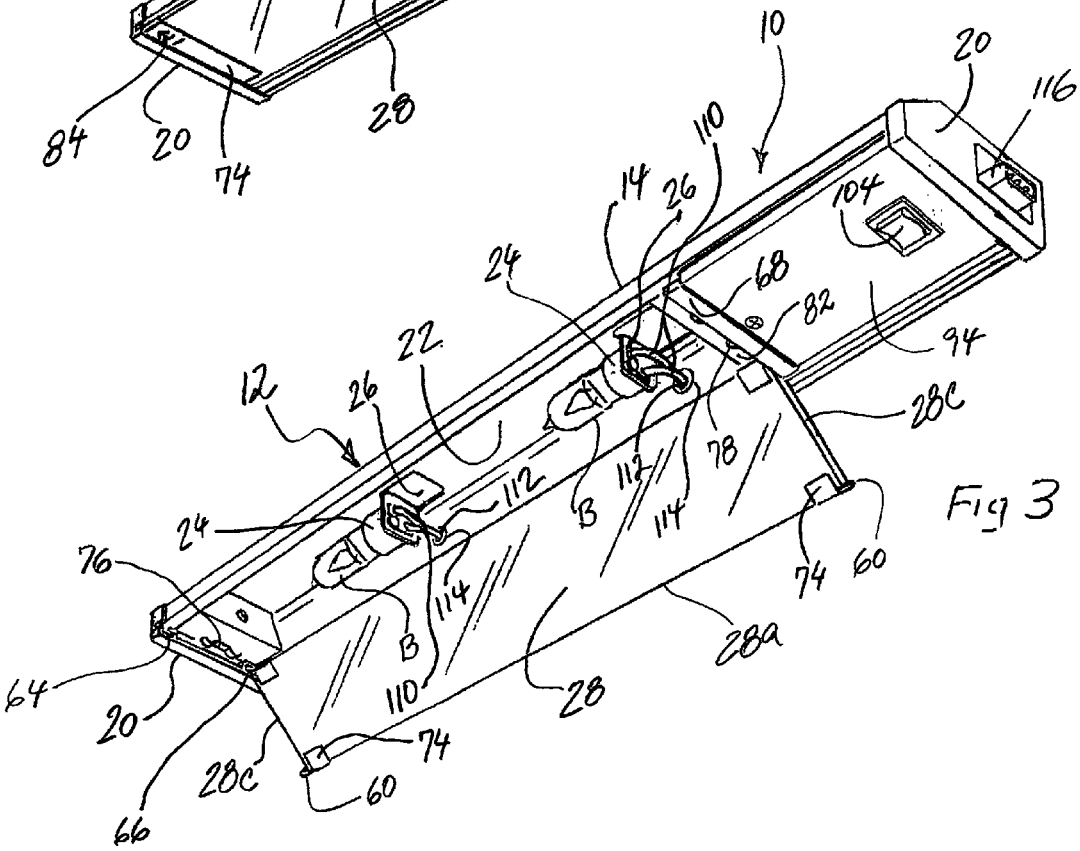
FIG. 3 is a view as in FIG. 2 showing the window panel in open condition for access to the lamps and lamp sockets under the reflector of the fixture.

With reference to the drawings wherein like elements are designated by like numerals, FIGS. 1, 2 and 3 show a counter light fixture 10 according to this invention, suitable for mounting to the underside of a wall hung cabinet for lighting an underlying counter surface. Counter light fixture 10 has a fixture housing 12 with a housing top 14, a rear compartment 16, and end caps 20 on opposite ends of the housing 12. A reflector 22 is supported under the housing top 14 facing the underside of housing 12. A translucent window panel 28 is supported to housing 12 under reflector 22. One or more lamp sockets 24 are supported on lamp brackets 26 under light reflector 22, and lamp bulbs B, such as halogen or xenon light bulbs, are inserted in sockets 24. For purposes of explanation and example the drawings show a two lamp fixture, but fixture 10 can be constructed in varying lengths to accommodate different numbers of lamp sockets 24.

As seen in the cross sectional views of FIGS. 4 through 7, the housing top 14 includes a top panel 32, a sloping front 34, a drop front 36, and a middle wall 38 which includes a sloping rear 40. The rear compartment 16 shares the middle wall 38 with the housing top 14 and further includes a bottom 42 and a back panel 44.

In the presently preferred embodiment the housing top 14 and rear compartment 16 are both part of a single extrusion 40. The housing top 14 can be generally described as a downwardly facing concave portion of the fixture housing 12 and the rear compartment 16 as an upwardly facing concave portion of the fixture housing 12. In other words, the cross sectional shape of extrusion 40 can be understood as being generally S shaped with the S turned ninety degrees clockwise to a horizontal position. The right half of the horizontal S defines the housing top 14 which accommodates reflector 22 and supports window panel 28. The left half of the horizontal S defines a trough extending along the length of the housing 12 between end caps 20 and which serves as rear compartment 16.

The open bottom of the housing top 14 is closed by the window panel 28. The open top of rear compartment 16 is covered and closed by a removable top cover 46 press fitted between the top edge 48 of back wall 54 and middle wall 38. The cover 46 is preferably flush or coplanar with top panel 32 of the housing top 14.

Light reflector 22 has a reflecting undersurface 48, a first reflector edge 50 captive in a front retaining slot 52 formed on the inside of housing front 36 and a second reflector edge 54 captive in a retaining slot 56 formed along middle wall 38. Reflector 22 can be made by bending resilient thin sheet material such as thin steel so that edges 50, 54 tend to spread apart from each other into corresponding retaining slots 52, 56 by spring force. As a result reflector 22 is supported in elastic compression between the housing front 36 and middle wall 38 of the housing top 14.

Figure 8:
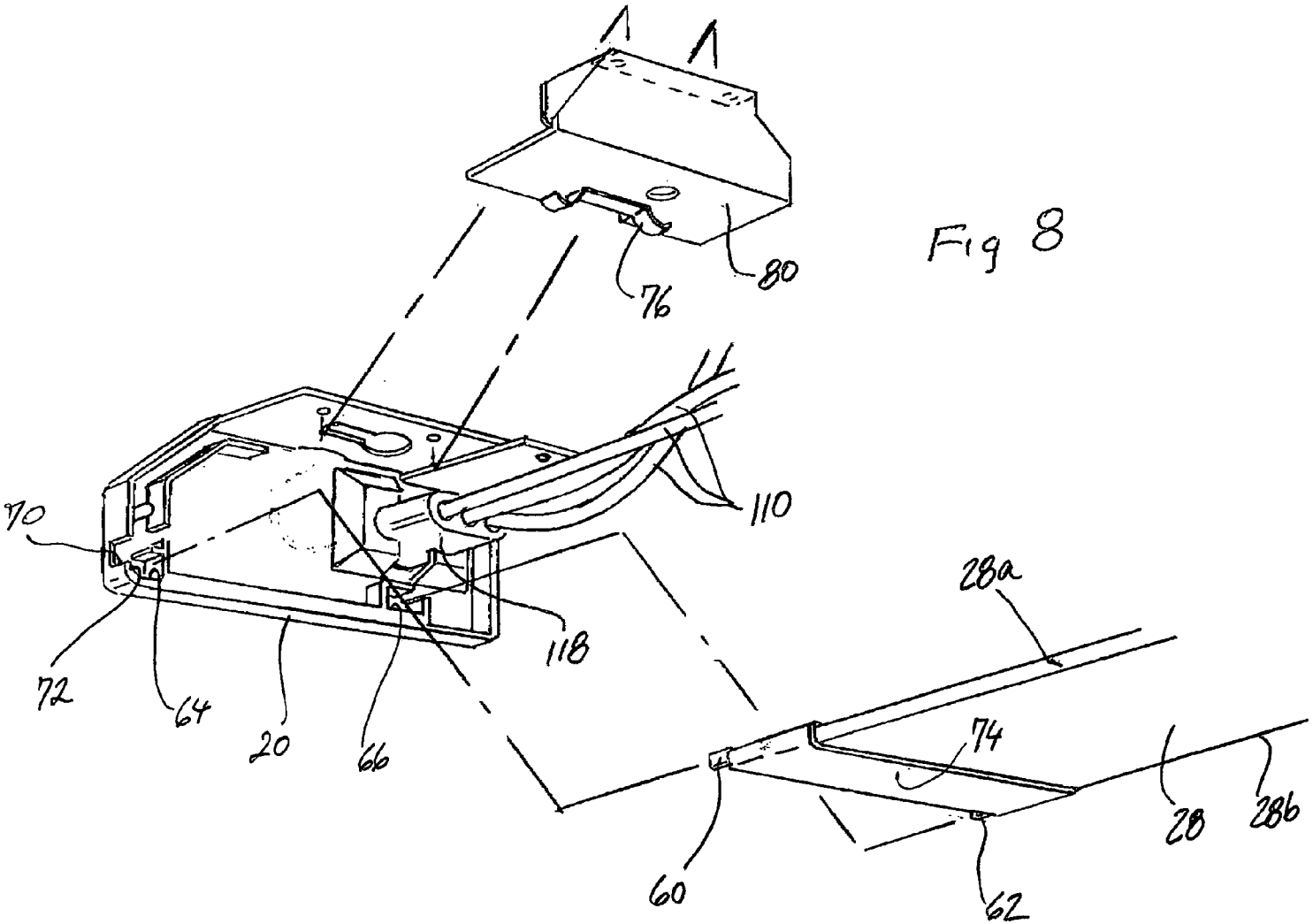
FIG. 8 is an exploded detailed view showing the left side end cap of the fixture of FIG. 1 with phantom lines indicating the front and rear slots corresponding to the front and rear pins on the left side of the window panel and also showing the spring support bracket in exploded relationship to the end cap.
Figure 9:
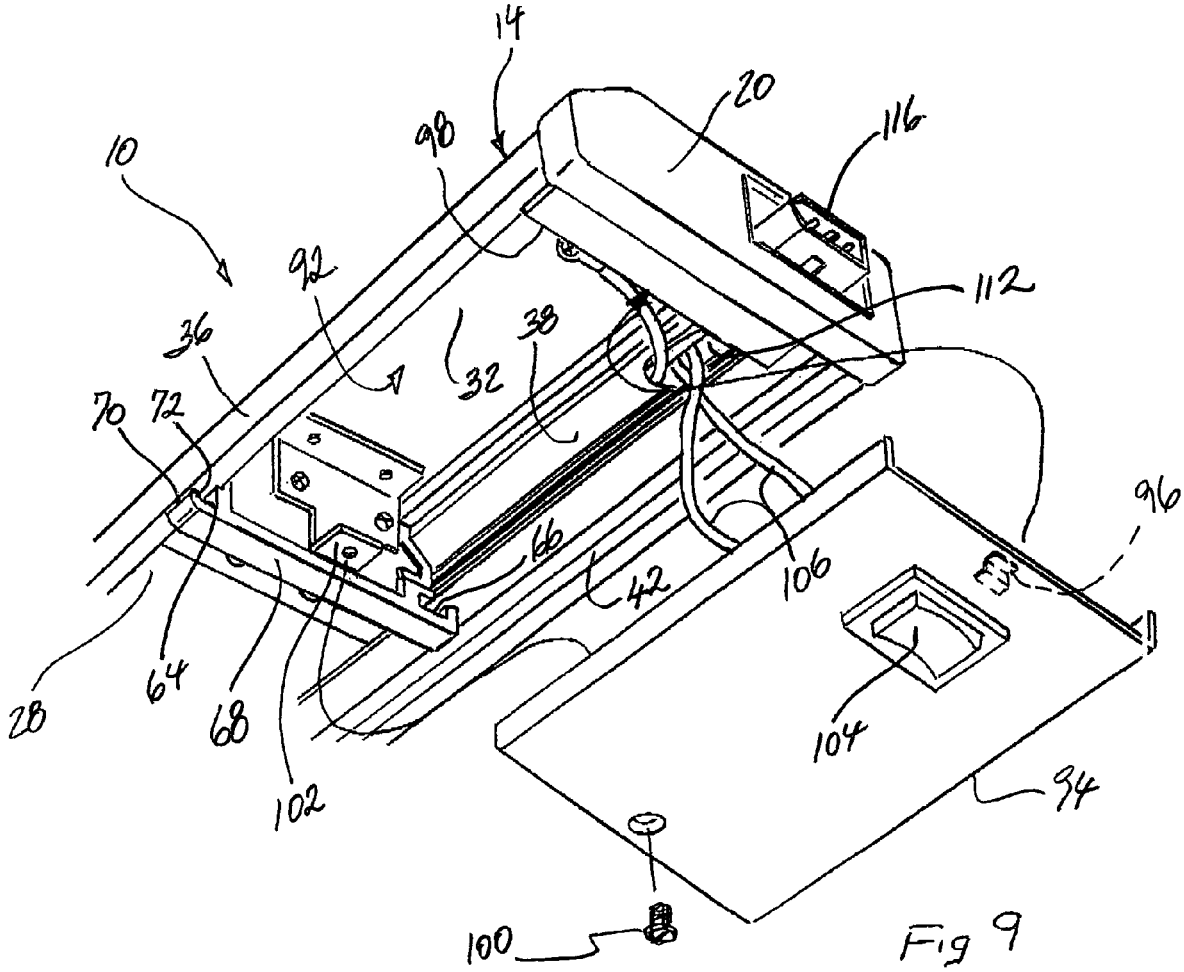
FIG. 9 is a detailed perspective view of the underside of the fixture of FIG. 1 showing the switch plate disengaged from the fixture housing to expose the interior of the switch compartment on the right end of the fixture.

The window panel 28 has a rear edge, a front edge **28*a* and two opposite sides 28*c* between the front edge and rear edge. On each side 28*c* window panel 28 has a front pin 60 and a rear pin 62. Each pin 60, 62 is supported in a corresponding front slot 64 and rear slot 66, respectively. Slots 64, 66 are defined in one end cap 20 at one end of reflector 22 as best seen in FIG. 8, and in a transverse partition 68 at the other end of reflector 22 as shown in FIG. 9. Front slots 64 have open forward ends 70. Rear slots 66 permit limited sliding displacement of window panel 28 in a generally horizontal plane as indicated by arrow B in FIG. 4. However, each front slot 64 has a pin detent 72 near its open forward end 70 shaped to hold the front pin 60 against sliding movement through the open end 70. Front pins 60 are released through open ends 70 by lifting the window panel 28 and pins 60 over the pin detents 72 as suggested by arrow A in FIG. 4 in order to free the window panel 28 from its normal closed operating condition of FIGS. 2 and 5 to a released condition shown in FIG. 4. Once front pins 60 are released from front slots 64 as in FIG. 4 the window panel 28 is itself released from its closed condition and is free to swing or pivot about the rear pins 62 captive in rear slots 66, allowing the front edge 28*a* to drop away from the fixture housing 12 to the open condition of the window panel 28. The two rear pins 62 remain captive in their corresponding rear slots 66 such that the rear edge 28*b* of window panel 28 remains hinged about rear pins 62 to housing 12 for pivotal movement to its open condition. The front pin 60 and rear pin 62 on each side 28*c* of the window panel 28 can be formed as integral parts of corresponding right and left clips 74 fitted on each end of window panel 28, as best seen in FIGS. 2, 3 and 8**.

Figure 7:
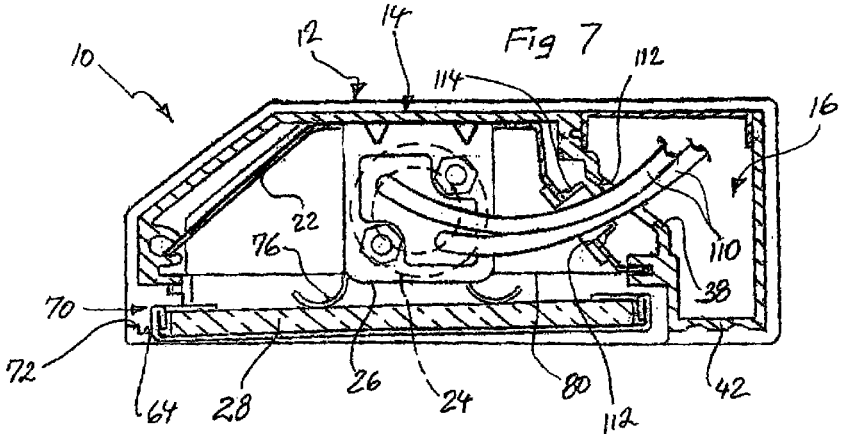
FIG. 7 is an elevational cross-section taken along line 7-7 in FIG. 2 showing electrical wiring passing from the rear compartment to a lamp socket for supplying electrical power to the socket.
Figure 5:
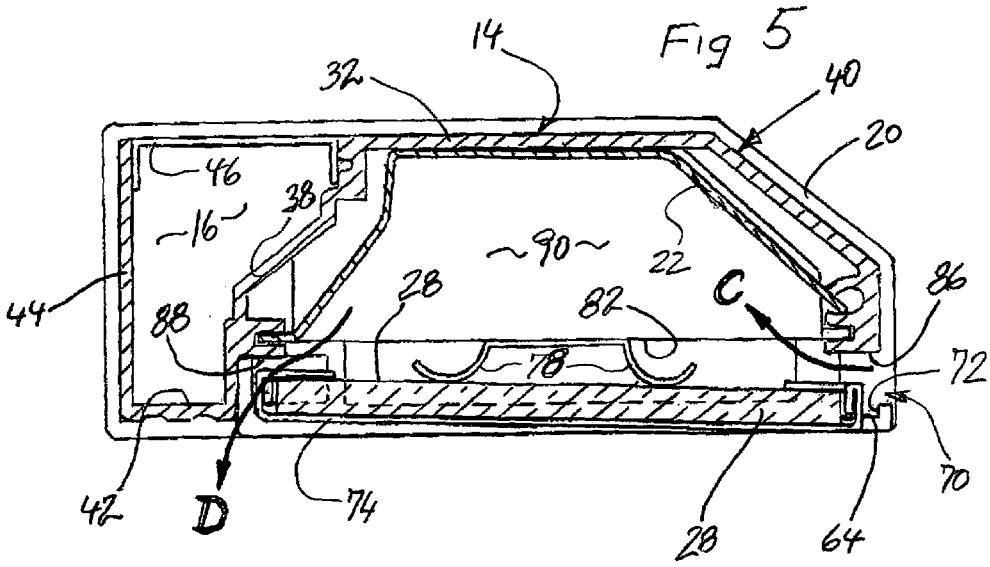
FIG. 5 is a cross-sectional view as in FIG. 4 showing the window panel in a normal closed condition with front and rear ventilation slots suggested by arrows in the Figure.
Figure 6:
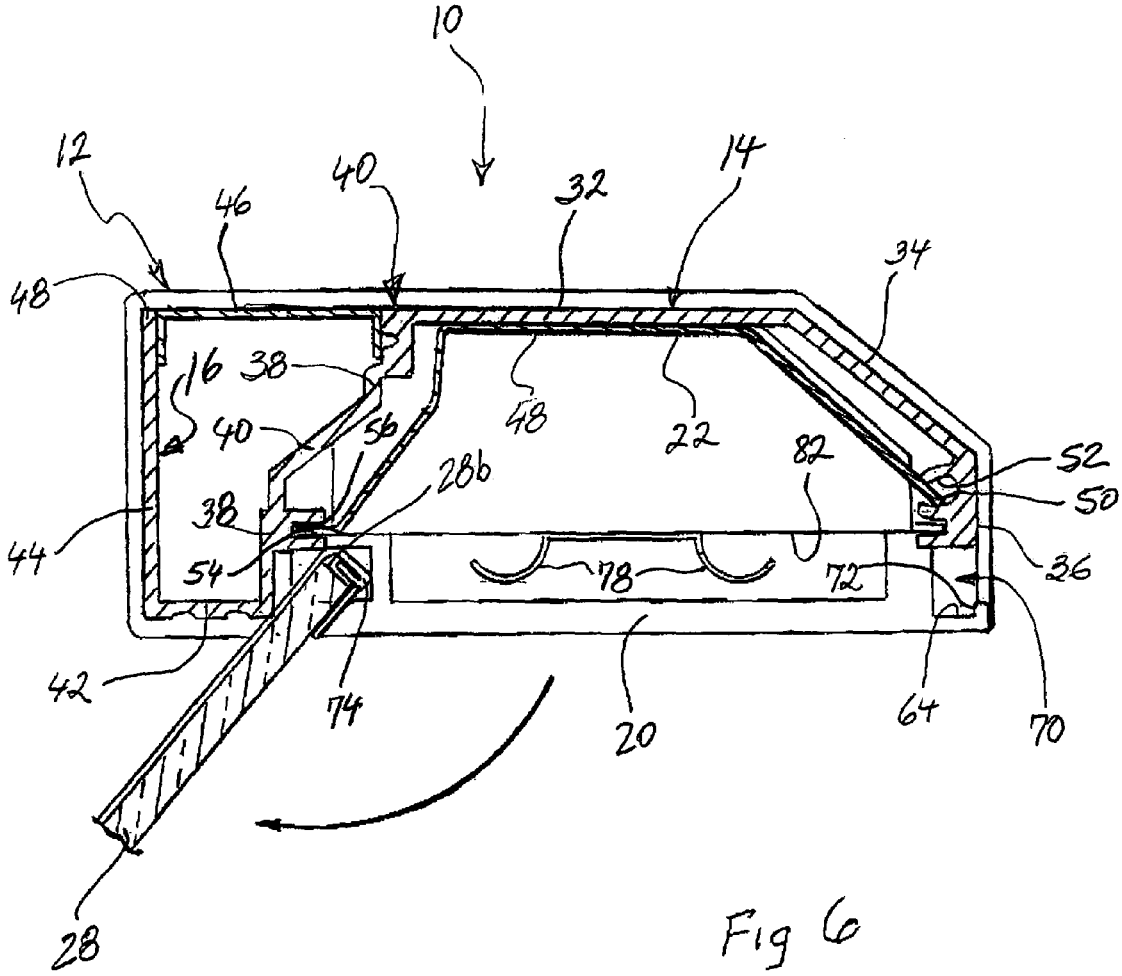
FIG. 6 is an elevational cross-section taken as in FIG. 5 showing the window panel lowered to its open condition.

In order to retain the window panel 28 against unintentional release, front pins 60 are spring loaded into a captive condition behind pin detents 72 by two leaf springs 76, 78 pressing down respectively on the left and right ends of the window panel as seen in FIGS. 5 and 7. A left spring 76 is fastened to the underside of a left bracket 80, and a right spring 78 is fastened to a right bracket 82. Springs 76, 78 resist lifting of front pins 60 over pin detents 72 and keep the window panel 28 from sliding out of its normal closed operating condition.

Figure 4:
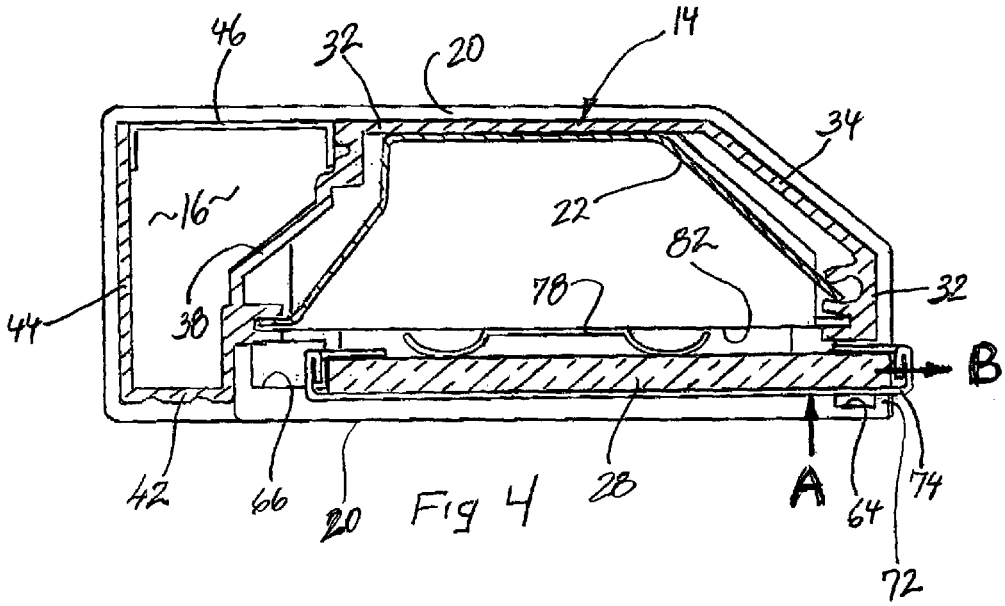
FIG. 4 is an elevational cross-section of the light fixture taken along the line 4-4 in FIG. 2 showing the window panel displaced for freeing the front pins from their detents by pressing the window panel upwards and forwards to a released condition as indicated by the arrows in the Figure in preparation for lowering the window panel to the open condition of FIG. 3.

The window panel is released from its closed condition by pressing upwardly on the opposite ends of the panel against the resistance of springs 76, 78 to overcome and compress the springs sufficiently to raise the front edge 28*a* of window panel 28 and lift front pins 60 over pin detents 72, while at the same time pushing window panel 28 forwardly in slots 64, 66, as suggested by arrows A and B in FIG. 4 until front pins 60 are freed from front slots 64. This task is facilitated by finger ridges 84 formed on the underside of each clip 74, as shown in FIG. 2.

The spring arrangement 76, 78 urges the front pins 60 into engagement with the corresponding pin detents 72 as just explained and also urges the window panel 28 away from fixture housing 12 thereby to provide ventilation into the fixture housing. The spring arrangement 76, 78 supports window panel 28 in spaced relationship to housing 12 in the closed condition of the window panel thereby to define a front ventilation slot 86 and a rear ventilation slot 88. The ventilation slots 86, 88 allow flow of air into and through the interior space 90 defined between reflector 22 and window panel 28, for example as suggested by arrows C and D in FIG. 5 to facilitate dissipation of heat from the light fixture 10.

The fixture housing 12 is divided by transverse partition 68 across extrusion 40 as best understood from FIGS. 3 and 9. Reflector 22 is contained between transverse partition 68 and left end cap 20. A switch compartment 92 is defined between partition 68 and right end cap 20. A removable bottom cover 94 closes switch compartment 92 and is secured by a catch 96 which fits over flange 98 and a screw 100 which passes through cover 94 and threads into bracket 102. An electrical power switch 104 is mounted to bottom cover 94 and is connected by electrical wires 106 for turning on and off electrical power to the lamp sockets 24 of the fixture 10.

Electrical wiring 110 is placed in rear compartment 16 and is connected through switch 104 for supplying and distributing electrical power to the lamp socket or sockets 24 of light fixture 10. The rear compartment 16 provides a conduit for the electrical wiring along the fixture housing 12. One or more pass-through openings 112 each preferably equipped with a protective sleeve 114 are provided in middle wall 38 and in reflector 22 to admit the wiring 110 from the rear compartment 16 to lamp sockets 24 as shown in FIGS. 3, 7 and 9.

Figure 12:
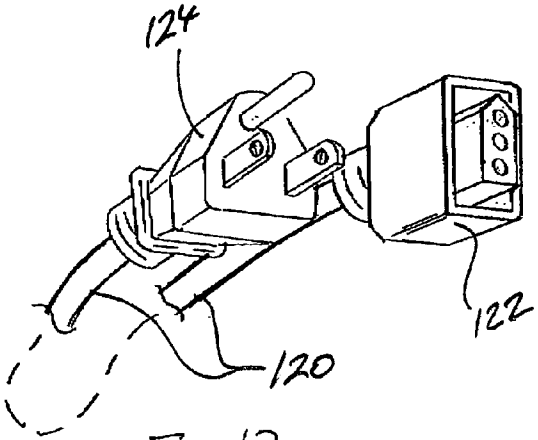
FIG. 12 shows the end connectors of a AC power cord by which the light fixture of FIG. 1 can be supplied with electrical power from an existing electrical outlet.
Figure 10:
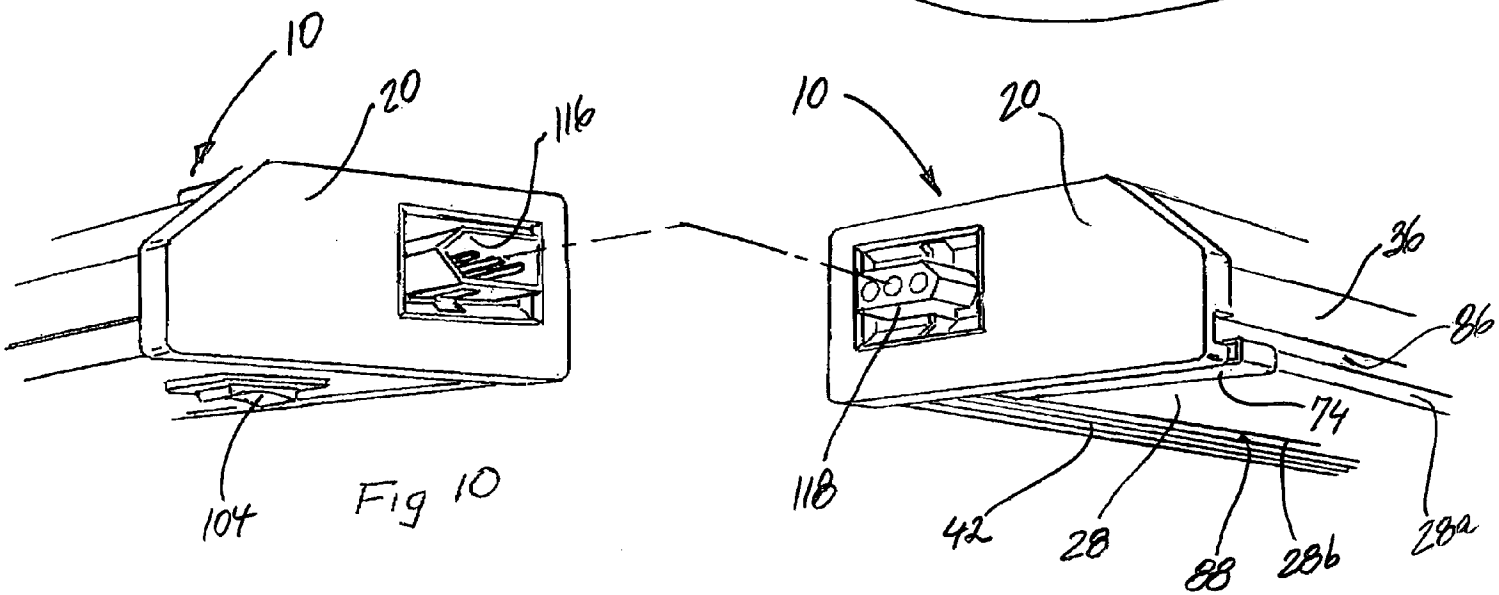
FIG. 10 depicts the mating of end connectors of opposite genders on two fixtures installed end-to-end.

The counter light fixture 10 can be configured for hard wired installation or for self-installation. For hard wired installation, typically done by an electrician, one or more knock out openings (not shown in the drawings) may be provided in a convenient location such as the back wall 44 for passing external electrical power wiring into rear compartment 16. For self-installation, male and female electrical connectors 116, 118 respectively are provided on end caps 20 as shown in FIGS. 1, 3, 9 and 10. End connectors 116, 118 may be connected to each other by wiring 110 in rear compartment 16 for passing electrical power through the fixture 10 from one end connector to the other. One or both end connectors 116, 118 are also normally connected for supplying power to lamp sockets 24. Either of connectors 116, 118 can mate to an external power cord 120 equipped with an appropriately configured mating connector 122 and a power plug 124 mateable to an electrical wall outlet, such as shown in FIG. 12 for supplying electrical power to the lamp sockets 24. Each connector 116, 118 can mate to a connector 116, 118 of opposite gender on an adjacent light fixture 10, for connecting end-to-end one counter light fixture 10 to another counter light fixture 10 as depicted in FIG. 10, so that only one of the connected light fixtures 10 requires connection to an external line voltage source.

Figure 11:
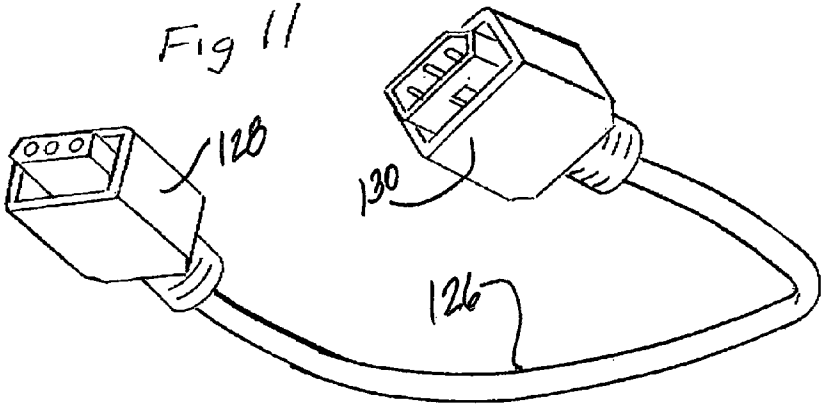
FIG. 11 shows a power jumper cable for connecting the end connectors of FIG. 10 where the fixtures are spaced apart from each other.

A jumper cord 126 such as shown in FIG. 11 may be provided with connectors 128, 130 of opposite gender for interconnecting end connectors 116, 118 of two spaced apart light fixtures 10, where direct mating of end connectors 116, 118 is not possible because of the spacing.

Figure 13:
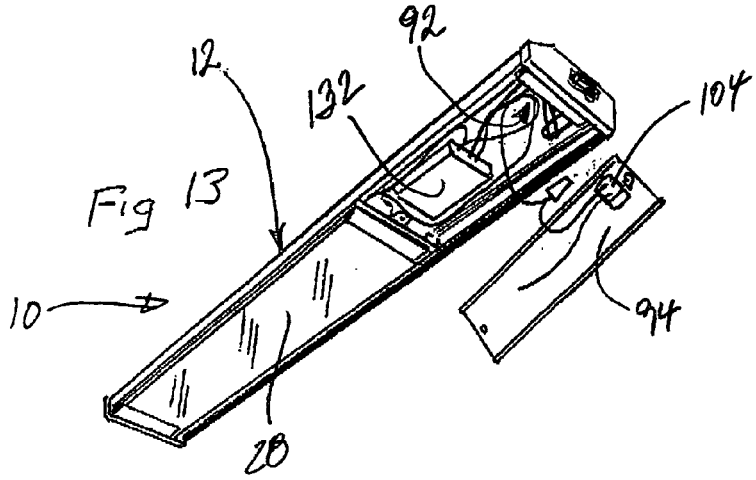
FIG. 13 is a front right bottom perspective view of the light fixture of FIG. 1 shown with the bottom cover open and a power transformer installed in the switch compartment.

The counter light fixtures of this invention can be configured for use with either high voltage (e.g. 110 Volts) or low voltage (e.g. 12 Volt) lamp bulbs in lamp sockets 24. For low voltage use a power transformer 132 is provided, which can be conveniently installed in switch compartment 92, as shown in FIG. 13, and connected for converting a line voltage input of the light fixture to a low voltage supply for the lamp sockets 24.

In embodiments of light fixture 10 where the number of lamp sockets 24 and corresponding lamp bulbs makes the housing 12 relatively long between end caps 20, it may be convenient to provide two shorter reflectors 22 with two corresponding window panels 28 instead of a single long reflector 22 and window panel 28. In such embodiment two or more translucent window panels 28 are each supported to a common light fixture housing 12 under a corresponding reflector 22 and each window panel 28 is independently releaseable for movement between a closed operating condition and an open condition permitting access to lamp sockets 24 mounted under the reflectors.

While a preferred embodiment of the invention has been described and illustrated for purposes of clarity and example it must be understood that many changes, modifications and substitutions will be apparent to those having only ordinary skill in the art without departing from the scope of this invention, which is defined by the following claims.

What is claimed is:

1. A counter light fixture comprising:

a fixture housing having a housing top, a front, a rear and opposite ends;

a reflector supported under said top and facing an underside of said housing;

one or more lamp sockets supported under said reflector and a translucent window panel supported under said reflector and slidable between a closed condition and a released condition, said window panel being supported against pivotal movement in said closed condition but pivotable from said released condition to an open condition for access to said lamp sockets.

2. The fixture of claim 1 further comprising a detent for detaining against said slidable movement, wherein said window panel is spring loaded into engagement with said detent in said closed condition.

3. The fixture of claims 1 or 2 wherein said window panel has a rear edge and a front edge, said rear edge is hinged to said housing, and said front edge is releasable towards said open condition.

4. The fixture of claim 2 wherein said window panel is released from said detent by pressing said window panel against said spring loading and sliding said window panel over said detent.

5. The fixture of claims 1 or 3 wherein said window panel is released from said closed condition for sliding movement towards said released condition by pressing said window panel towards said housing top.

6. The fixture of claims 1 or 2 wherein said window panel is supported in spaced relationship to said housing in said closed condition thereby to define a front ventilation slot.

7. The fixture of claims 1 or 2 wherein said window panel is supported in spaced relationship to said housing in said closed condition thereby to define a rear ventilation slot.

8. The fixture of claims 1 or 2 wherein said window panel is supported in spaced relationship to said housing in said closed condition thereby to define a front ventilation slot and a rear ventilation slot.

9. The fixture of claims 1 or 2 further comprising a spring arrangement urging said window panel away from said housing top thereby to provide ventilation into said housing and also urging said window panel into a detent operative for holding said panel against sliding to said released condition.

10. The fixture of claim 1 wherein said fixture housing is an extrusion of substantially constant cross section between said opposite ends having a housing top and a rear compartment of approximately equal length between said opposite ends.

11. The fixture of claim 10 further comprising a partition transverse to said housing top, a switch compartment defined between said partition and one of said ends, and a removable bottom cover for closing said switch compartment.

12. The fixture of claim 11 further comprising an electrical switch mounted on said bottom cover.

13. The fixture of claim 11 further comprising a power transformer in said switch compartment connected for converting a line voltage input to a low voltage supply for said lamp sockets.

14. The fixture of claim 10 further comprising electrical wiring in said rear compartment connected to said least one lamp socket through openings in said reflector.

15. The fixture of claim 14 wherein said electrical wiring is connected to an electrical power switch.

16. The fixture of claim 1 or claim 27 or claim 52 further comprising knock out openings in a back wall of said rear compartment for passing electrical power wiring into said rear compartment.

17. The fixture of claim 1 or claim 27 further comprising male and female electrical connectors at said housing ends for connecting end-to-end one said counter light fixture to another said counter light fixture.

18. The fixture of claim 17 further comprising a power cord mateable to one of said male and female electrical connectors for supplying electrical power to said lamp sockets.

19. A counter light fixture comprising:

a fixture housing having a housing top, a front, a rear and opposite ends;

a reflector supported under said top and facing an underside of said housing;

one or more lamp sockets supported under said reflector;

a translucent window panel supported under said reflector and hinged to said housing for movement between a closed operating condition and an open condition permitting access to said lamp socket;

wherein said window panel has a rear edge and a front edge, said rear edge is hinged to said housing and said front edge is releasable towards said open condition, and two opposite sides between said front edge and said rear edge and a front pin and a rear pin on each of said sides, each of said pins being captive in a corresponding slot in said housing, said front pin being slidable in said corresponding slot for freeing said front pin through an open forward end thereof thereby to release said window panel for movement about said rear pin to said open condition.

20. The fixture of claim 19 further comprising a spring arrangement urging said window panel away from said housing thereby to provide ventilation into said housing.

21. The fixture of claim 19 wherein said front pin and said rear pin are integral with a clip fitted on each of said sides of said window panel.

22. The fixture of claim 21 further comprising finger ridges defined on each said clip.

23. The fixture of claim 19 further comprising a detent in said corresponding slot for retaining said front pin against sliding movement towards said open forward end in said slot, said detent allowing said front pin to be lifted over the detent and towards said open forward end thereby to free said front pin from said slot.

24. The fixture of claim 23 further comprising a spring arrangement urging said front pin into engagement with said detent.

25. The fixture of claim 24 wherein said spring arrangement also urges said window panel away from said housing top thereby to admit ventilation therebetween.

26. A counter light fixture comprising:

a fixture housing having a housing top, a front, a rear and opposite ends;

a reflector supported under said top and facing an underside of said housing;

one or more lamp sockets supported under said reflector; and a plurality of translucent window panels each hinged to said housing under a corresponding said reflector and each said window panel being independently releaseable for movement between a closed operating condition and an open condition permitting access to said lamp sockets.

27. A counter light fixture comprising:

a housing formed as a unitary extrusion of substantially constant cross section between opposite housing ends and having a housing top and a rear compartment having a bottom and extending from one to the other of said opposite housing ends, a reflector supported under said top and facing an underside of said housing, one or more lamp sockets supported under said reflector, and wiring in said rear compartment connected to said one or more lamp sockets and to one or more of said end connectors; and further comprising a partition transverse to said housing top, a switch compartment defined between said partition and one of said ends, a removable bottom cover for closing said switch compartment and a transformer in said switch compartment connected for converting a line voltage input to a low voltage supply for said one or more lamp sockets.

28. The light fixture of claim 27 wherein said housing top and said rear compartment share a middle wall integral with said extrusion and said wiring passes through openings in said middle wall.

29. The light fixture of claim 27 wherein said extrusion is a metal extrusion.

30. The light fixture of claim 27 wherein said extrusion is an aluminum extrusion.

31. The light fixture of claim 27 wherein said housing top comprises a top panel, a housing front including a sloping front portion and a drop front portion, and a middle wall of said extrusion.

32. A counter light fixture comprising:

a housing having a housing top and a rear compartment extending between opposite housing ends, a reflector supported under said top and facing an underside of said housing, one or more lamp sockets supported under said reflector, and wiring in said rear compartment connected to said one or more lamp sockets and to one or more of said end connectors, wherein said housing top and said rear compartment are portions of a unitary extrusion wherein said rear compartment comprises a middle wall, a bottom and a back wall of said extrusion.

33. A counter light fixture comprising:

a housing having a housing top and a rear compartment extending between opposite housing ends, a reflector supported under said top and facing an underside of said housing, one or more lamp sockets supported under said reflector, and wiring in said rear compartment connected to said one or more lamp sockets and to one or more of said end connectors, wherein said housing top and said rear compartment are portions of a unitary extrusion wherein said housing top has a housing front and a middle wall, and said rear compartment shares said middle wall and further has a bottom and a back wall.

34. The light fixture of claim 32 or claim 33 further comprising a removable top cover for closing said rear compartment between said back wall and said middle wall.

35. The light fixture of claim 33 wherein said reflector is supported to said housing top by elastic compression between said housing front and said middle wall.

36. The fixture of claim 33 further comprising a partition transverse to said housing top, a switch compartment defined between said partition and one of said ends, and a removable bottom cover for closing said switch compartment.

37. The fixture of claim 36 further comprising a switch mounted to said bottom cover and connected to said wiring.

38. The fixture of claim 27 or claim 33 further comprising electrical connectors of opposite gender at said housing ends, said electrical connectors being connected to said wiring in said rear compartment for supplying electrical power to said lamp sockets.

39. A counter light fixture comprising:

a housing having a housing top and a rear compartment of substantially equal length extending between opposite housing ends, a reflector supported under said top and facing an underside of said housing, one or more lamp sockets supported under said reflector, and wiring in said rear compartment connected to said one or more lamp sockets and to one or more of said end connectors, wherein said housing top and said rear compartment are portions of a unitary extrusion including a bottom of said rear compartment integral with said extrusion, and a translucent window panel supported to said housing under said reflector and releaseable for movement between a closed operating condition and an open condition permitting access to said one or more lamp sockets.

40. The fixture of claim 39 wherein said window panel is supported in spaced relationship to said housing in said closed condition thereby to define one or both of a front ventilation slot and a rear ventilation slot.

41. The fixture of claim 27 or claim 39 wherein said housing top is a downward facing concave portion of said extrusion.

42. The fixture of claim 39 wherein said rear compartment is an upward facing concave portion of said extrusion.

43. A light fixture comprising a fixture housing having a downwardly facing concave top section joined to an upwardly facing concave rear section, one or more lamp sockets supported under the downwardly facing concave top section, and electrical wiring in the upwardly facing concave rear section connected to said one or more lamp sockets.

44. The light fixture of claim 43 further comprising a translucent window panel under said downwardly facing concave top section.

45. The light fixture of claim 43 further comprising a reflector under said downwardly facing concave top section.

46. The light fixture of claim 43 further comprising a removable top cover for covering the upwardly facing concave rear section.

47. The light fixture of any of claims 43 through 46 wherein said downwardly facing concave top section and said upwardly facing concave rear section are portions of a unitary extrusion.

48. A light fixture comprising a fixture housing having a downwardly facing concave top section joined to an upwardly facing concave rear section, a reflector under said downwardly facing concave top section, one or more lamp sockets supported under said reflector, a translucent window panel under said downwardly facing concave top section, and electrical wiring in the upwardly facing concave rear section connected to said one or more lamp sockets.

49. The light fixture of claim 48 further comprising a removable top cover for covering the upwardly facing concave rear section.

50. The light fixture of claim 48 or claim 49 wherein said downwardly facing concave top section and said upwardly facing concave rear section are portions of a unitary extrusion.

51. The light fixture of claim 48 wherein said translucent window panel is hinged to said housing for movement between a closed operating condition and an open condition permitting access to said lamp sockets.

52. A light fixture comprising a fixture housing having opposite housing ends and a substantially constant cross section between said opposite ends a downwardly facing concave top section joined to an upwardly facing concave rear section, a reflector under said downwardly facing concave top section, one or more lamp sockets supported under said reflector, a translucent window panel under said downwardly facing concave top section, and electrical wiring in the upwardly facing concave rear section connected to said one or more lamp sockets.

53. The light fixture of claim 52 further comprising a removable top cover for covering the upwardly facing concave rear section.

54. A counter light fixture comprising:

a housing comprising an extrusion of substantially constant cross section between opposite housing ends, said extrusion divided by an integral middle wall into a housing top and a rear compartment both extending from one to the other of said opposite housing ends, one or more lamp sockets supported under said housing top, and wiring in said rear compartment connected through an opening in said middle wall to said one or more lamp sockets, and end caps on said opposite housing ends.

55. The light fixture of claim 54 further comprising a partition dividing said rear compartment into a switch compartment.

56. The light fixture of claim 54 further comprising a translucent window panel supported to said housing under said sockets.

57. The light fixture of claim 54 further comprising a reflector supported under said housing top and facing an underside of said housing.

58. The light fixture of claim 54 further comprising a removable cover for closing said rear compartment.

59. A counter light fixture comprising:

a housing having opposite housing ends and substantially constant cross section between said ends, a middle wall extending between said ends a housing top on one side of said middle wall and a rear compartment on an opposite side of said middle wall, both extending from one to the other of said opposite housing ends, one or more lamp sockets supported under said housing top, and wiring in said rear compartment connected through an opening in said middle wall to said one or more lamp sockets, a rear cover removable for accessing the wiring in said rear compartment, and end caps on said opposite ends for closing said rear compartment, and a translucent window panel supported by said end caps under said lamp sockets.

60. The light fixture of claim 59 wherein said housing is of substantially constant cross section between said opposite housing ends.

61. The light fixture of claim 59 further comprising an electrical transformer and a power switch in said rear compartment connected to said wiring for supplying and controlling electrical power to said sockets.

* * * * *